US006577845B2

(12) United States Patent
Stevens

(10) Patent No.: US 6,577,845 B2
(45) Date of Patent: Jun. 10, 2003

(54) END TO END BINDING USING IMAGING MATERIAL AND CONTINUOUS SHEET PRINTING

(75) Inventor: Chad A. Stevens, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 45 days.

(21) Appl. No.: 09/963,067

(22) Filed: Sep. 24, 2001

(65) Prior Publication Data

US 2003/0059280 A1 Mar. 27, 2003

(51) Int. Cl.[7] ..... G03G 15/00

(52) U.S. Cl. ..... 399/408; 270/52.18; 270/58.08; 399/409; 412/1; 412/6

(58) Field of Search ..... 399/408, 409; 412/1, 6, 8; 493/187, 188; 270/52.18, 58.07, 58.08; 156/277, 384–386

(56) References Cited

U.S. PATENT DOCUMENTS 5,014,092 A * 5/1991 Kubo et al. ..... 399/409
5,531,429 A * 7/1996 Clark ..... 399/408 X
6,394,728 B1 * 5/2002 Boss ..... 412/1
6,459,880 B1 * 10/2002 Russell ..... 399/408

* cited by examiner

*Primary Examiner*—William J. Royer

(57) ABSTRACT

Using imaging material binding techniques to simulate continuous sheet printing with single sheets of print media. Imaging material is applied to a binding region along the trailing edge of a first sheet. The trailing edge of the first sheet and the leading edge of a following second sheet are overlapped and the imaging material is activated to bind the sheets together. This process may be repeated for successive sheets to form one continuous sheet. The invention may be implemented, for example, in a stand alone appliance used in conjunction with a conventional single sheet printer, as an integrated printing device, or through a computer readable medium used to control operations in one or both of these devices.

19 Claims, 14 Drawing Sheets

END TO END BINDING USING IMAGING MATERIAL AND CONTINUOUS SHEET PRINTING

FIELD OF THE INVENTION

The present invention relates to post print finishing in which printed sheets are bound end to end using imaging material to form a continuous sheet.

BACKGROUND OF THE INVENTION

Current devices and methods for printing and binding media sheets involve printing the desired document on a plurality of media sheets, assembling the media sheets into a stack, and separately stapling, clamping, gluing and/or sewing the stack. In addition to imaging material used to print the document, each of these binding methods require separate binding materials, increasing the cost and complexity of binding. Techniques for binding media sheets using imaging material are known in the art. These techniques generally involve applying imaging material such as toner to defined binding regions on multiple sheets, assembling the media sheets into a stack, and reactivating the imaging material via fusing or other methods, causing the media sheets to adhere to one another.

Presently, printed banners and other long printed materials are printed on a continuous length of paper or other print media using a plotter or printing press, or by manually assembling and binding together a series of single sheets. In the case of continuous sheet printing, rolls of paper and roll supply devices are necessary. Manually assembling and binding single sheets is, of course, labor intensive and therefore expensive. It would be desirable, as an alternative to conventional continuous sheet printing techniques, to use single sheet printing to automatically produce continuous sheets of printed materials.

SUMMARY

The present invention is directed to the use of imaging material binding techniques to simulate continuous sheet printing with single sheets of print media. Accordingly, in one exemplary embodiment of the invention imaging material is applied to a binding region along the trailing edge of a first sheet. The trailing edge of the first sheet and the leading edge of a following second sheet are overlapped and the imaging material is activated to bind the sheets together. This process may be repeated for successive sheets to form one continuous sheet. The invention may be implemented, for example, in a stand alone appliance used in conjunction with a conventional single sheet printer, as an integrated printing device, or through a computer readable medium used to control operations in one or both of these devices.

DETAILED DESCRIPTION OF THE INVENTION

Figure 1:
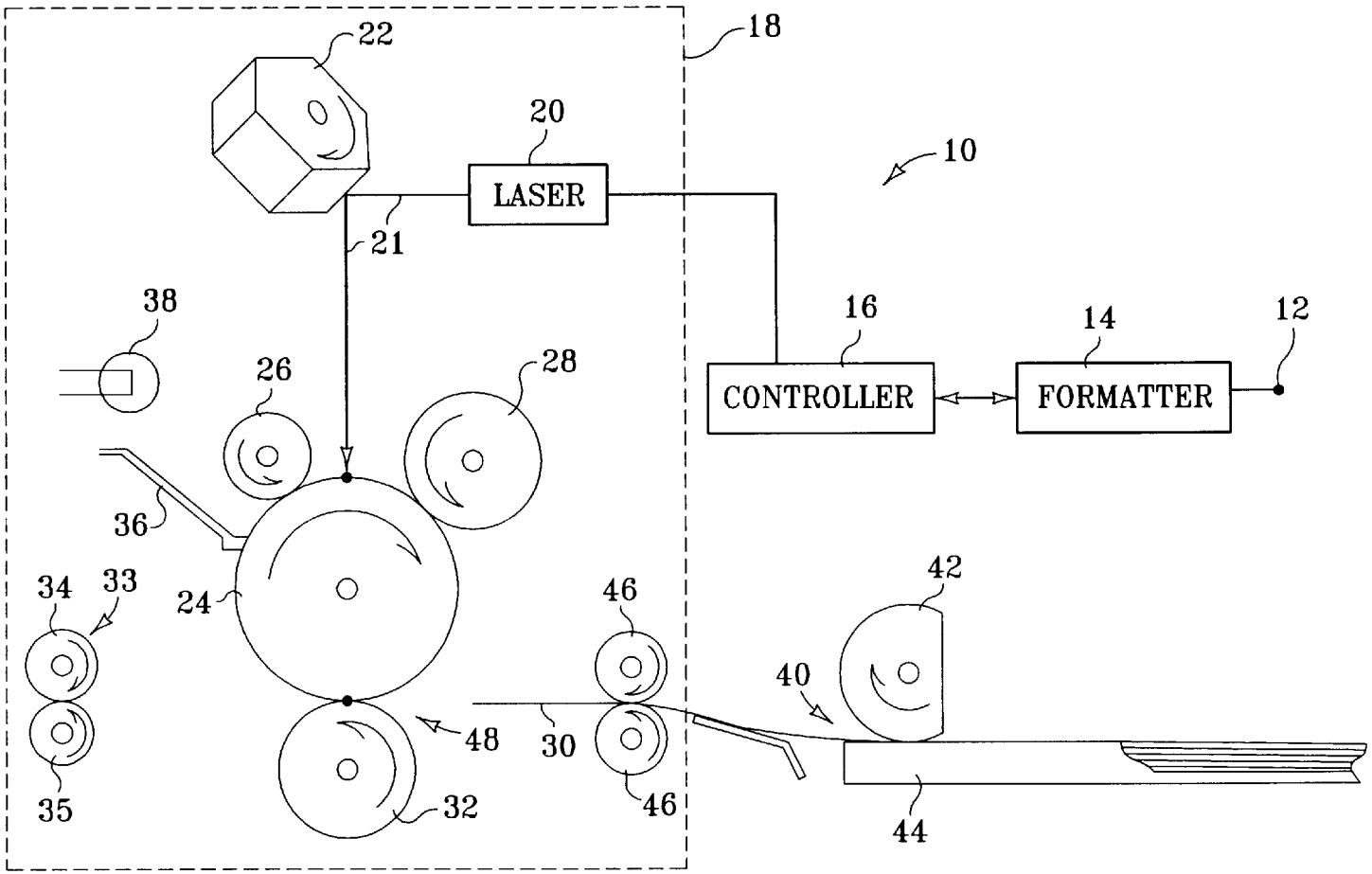
FIG. 1 is a schematic view of a laser printer illustrating the major components and operational characteristics of one type of printing device that may be used to implement the present invention.

FIG. 1 is a schematic view of a laser printer illustrating the major components and operational characteristics of one type of printing device that may be used to implement the present invention. FIGS. 2–5 and 6–9 are side views of a laser printer such as the one illustrated in FIG. 1 showing the sequence of operation for two embodiments of the invention in which sheets are bound end to end with toner. Although these two embodiments of the invention are described with reference to a laser printer, which uses toner as the imaging material, the invention may be implemented with other printing devices using other imaging materials including, for example, inkjet printers. FIGS. 10–13 illustrate another embodiment of the invention in which the sheets are bound in a sorter/stacker attached to a printer. In this embodiment, the printer 70 and stacker 72 represent generally any suitable printing device (e.g., printers, copiers, and multi-function peripherals) and associated post print finishing device in which the imaging material can be used to bind a printed documented.

In as much as the art of electrophotographic laser printing is well known, the basic components of one exemplary laser printer 10 in FIG. 1 are shown schematically and their operation described only briefly. In general, and referring to FIG. 1, document generating software on a personal computer, a scanner or some other input device transmits data representing the desired print image to input 12 on printer 10. This data is analyzed in formatter 14. Formatter 14 typically consists of a microprocessor and related programmable memory. The binding region on which toner will be applied to bind sheets together may be selected by the input device and sent on to the printer iQ along with or as part of the print image data. Alternatively, the binding region may be selected by formatter 14 or by programming for a stand alone document processing and finishing device such as the stacker 72 shown in FIGS. 10–13. Formatter 14 formulates and stores an electronic representation of each page to be printed, including the print image and the binding region.

Once a page has been formatted, the data representing each page is sent to a printer controller 16. Controller 16, which also includes a microprocessor and related programmable memory, directs and manages the operation of print engine 18. Formatter 14 and controller 16 are often integrated together as a single processor/memory component of a printer 10. The page data is used by controller 16 to modulate a light beam 21 produced by laser 20 such that the light beam 21 "carries" the page data. The light beam 21 is reflected off a multifaceted spinning mirror 22. As each facet of mirror 22 spins through light beam 21, it reflects or "scans" the light beam 21 across the surface of a photoconductive drum 24 to reproduce the page on the drum 24.

A charging roller 26 charges drum 24 to a relatively high substantially uniform polarity at its surface. The areas of drum 24 exposed to light beam 21 are discharged. The unexposed background areas of drum 24 remain fully charged. This process creates a latent electrostatic image on drum 24. Toner is electrostatically transferred from a developing roller 28 onto drum 24 according to the data previously recorded on the drum 24. The toner is thereafter transferred from drum 24 onto paper or another media sheet 30 as sheet 30 passes between drum 24 and a transfer roller 32. The toner is fused to the sheet at a fuser 33. Fuser 33 includes fuser rollers 34 and 35 that apply heat and pressure to each sheet as it passes between the rollers 34 and 35. Drum 24 is cleaned of excess toner with a cleaning blade 36, completely discharged by discharge lamp 38 and then recharged by a charging roller 26.

The marking assembly in an electrophotographic printer, such as a laser printer 10, includes a photoconductor like drum 24 and the other components necessary to apply toner to a sheet 30. The term "marking assembly" as used herein also refers generally to the components in any printing device that apply imaging material to the media. The print head in an inkjet printer or the print head in a direct projection electrostatic toner printer are also examples of a marking assembly.

Figure 2:
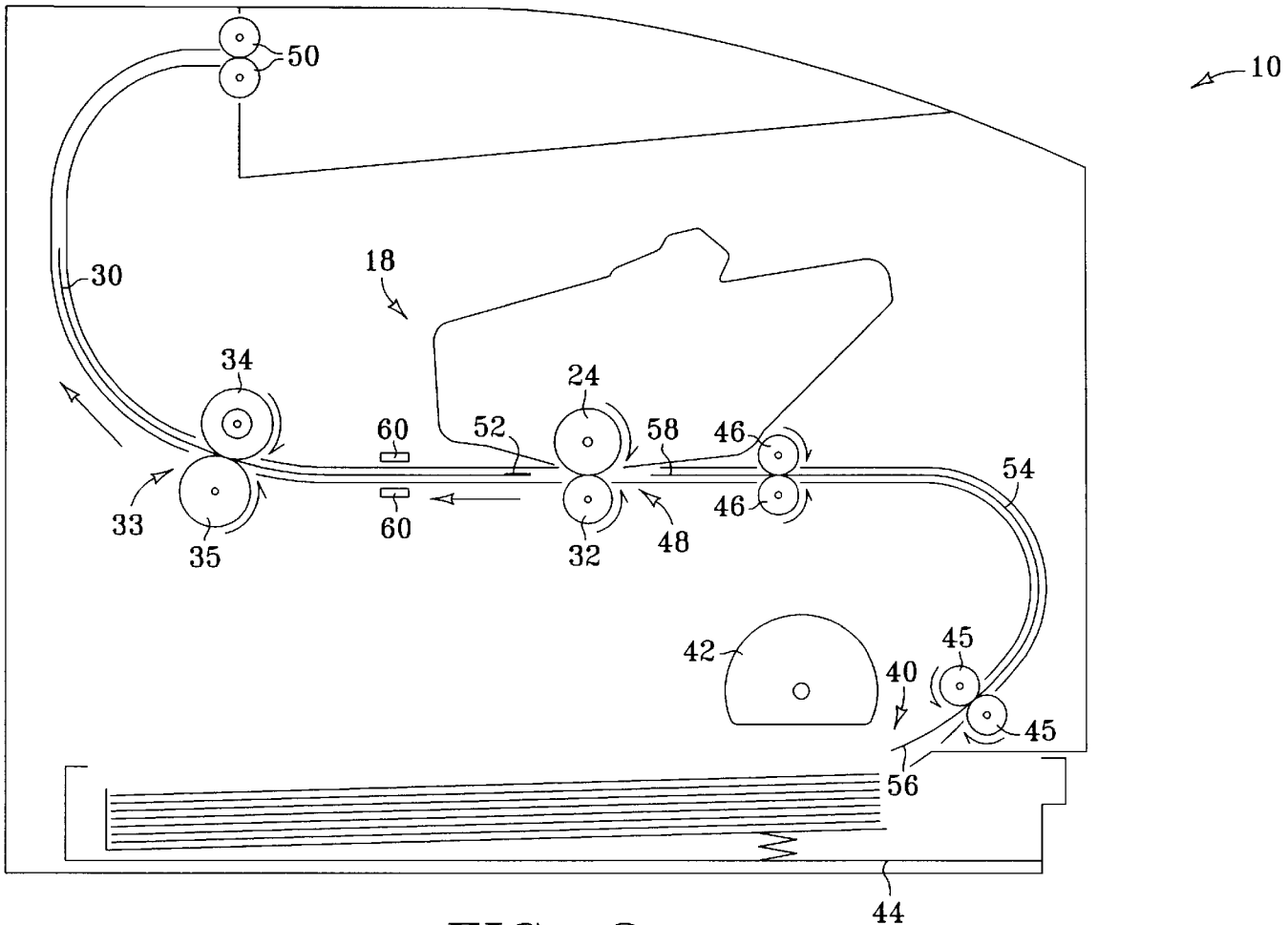
FIGS. 2–5 are side views of a laser printer such as the one illustrated in FIG. 1 showing the sequence of operation for one embodiment of the invention in which sheets are bound end to end with the printer fuser.

Referring now also to FIG. 2, each media sheet 30 is pulled into a pick/feed area 40 by a feed roller 42 from a paper tray 44. As the leading edge of sheet 30 moves through pick/feed area 40, it is engaged by transport rollers 45 which advance to sheet 30 to registration rollers 46. Registration rollers 46 advance sheet 30 to image area 48 until it is engaged by drum 24 and transfer roller 32 and toner is applied as described above. Media sheet 30 advances to fuser 33 and on to output rollers 50.

The continuous sheet binding according a one embodiment of the invention will now be described with reference to FIGS. 2–5. In FIG. 2, a first media sheet 30 has cleared image area 48 and is passing through fuser 33. Toner has been applied to trailing edge 52 of first sheet 30 along with the desired print image, if any, as first sheet 30 passed through image area 48. A second sheet 54 is approaching image area 48. Toner will also be applied to trailing edge 56 of second sheet 54 along with the desired print image, if any, as second sheet 31 passes through image area 48. Toner need not be applied to the trailing edge of the final page since no binding will occur on that edge.

Figure 3:
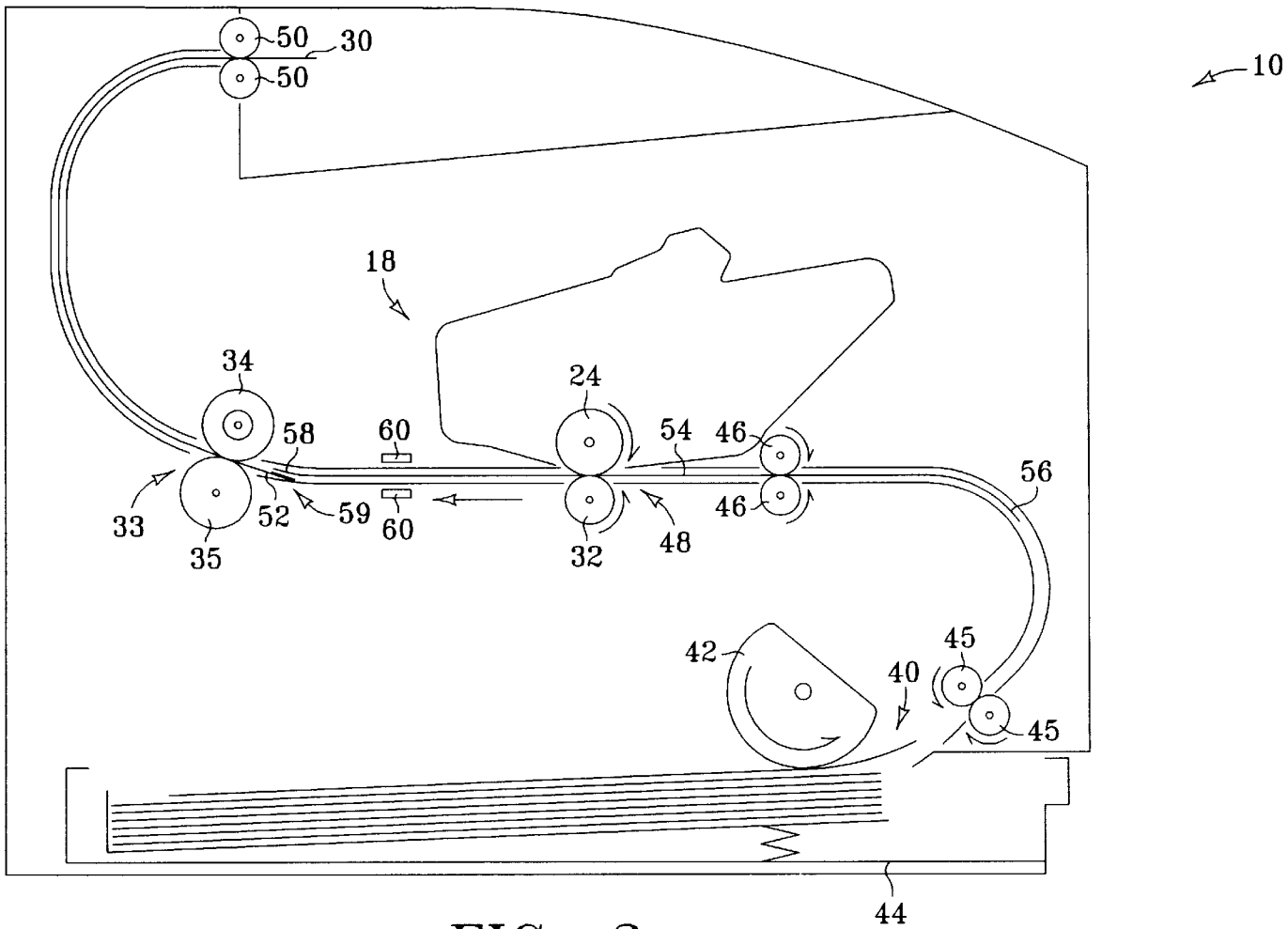
Figure 4:
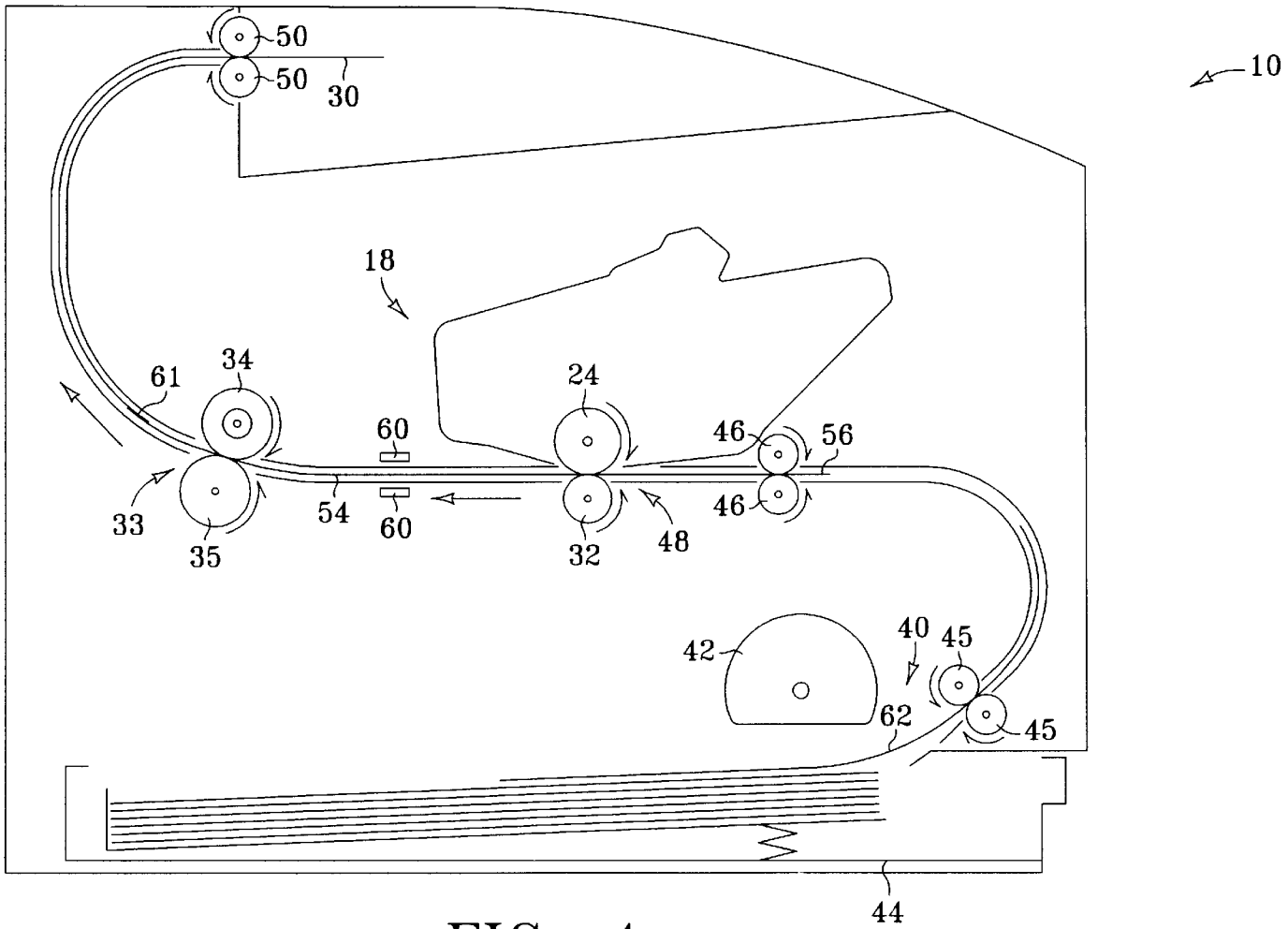
Figure 5:
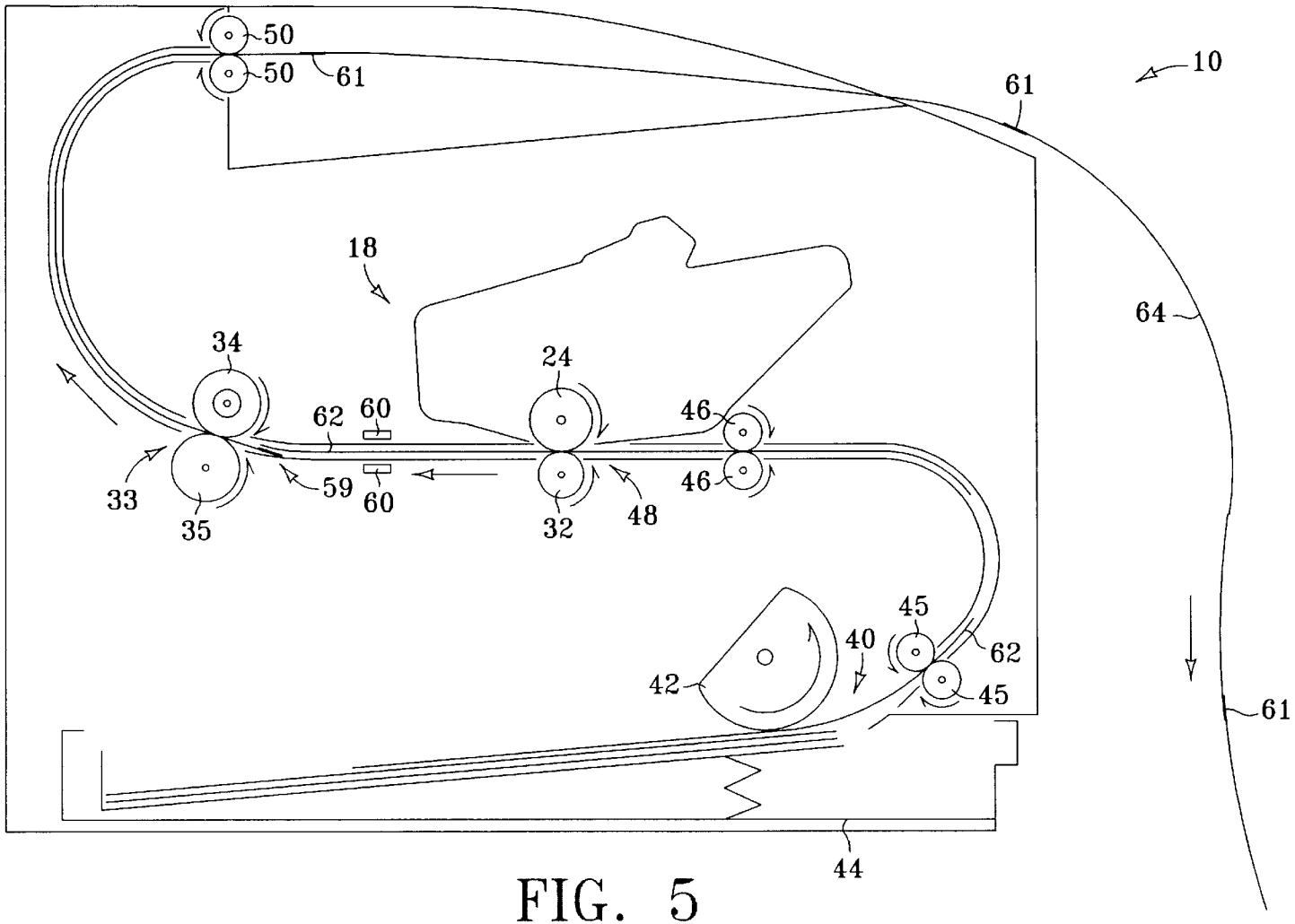

Referring to FIG. 3, as the leading edge 58 of second sheet 54 passes through image area 48 and approaches fuser 33, it overlaps trailing edge 52 of first sheet 30. This overlap is designated by reference number 59 in FIGS. 2–9. In the preferred embodiment, this overlap is achieved by varying the speed of fuser rollers 34, 35 and output rollers 50. For example, when leading edge 58 of second sheet 54 is detected by a sensor 60 positioned between image area 48 and fuser 33, the speed of fuser rollers 34,35 and output rollers 50 is slowed temporarily to allow leading edge 58 of second sheet 54 to overtake trailing edge 52 of first sheet 30. Once the desired overlap is achieved, the speed of fuser rollers 34, 35 and output rollers 50 is resumed to again match the speed of the two sheets 30 and 54. Sensor 60 represents generally a conventional electromechanical or photo-optic sensor or any other sensor suitable to detect the presence of the leading edge of each sheet as it passes from image area 48 to fuser 33. The overlapping edges of sheets 30 and 54 are fused together as they pass through fuser 33 to form a fused joint 61. This process is repeated for successive sheets 62 to form a continuous sheet 64 as shown in FIGS. 4 and 5.

FIGS. 6–9 illustrate another embodiment of the invention in which sheets are bound end to end with a binding press 66 positioned downstream from fuser 33. The sequence of operation is the same as that described above for FIGS. 2–5, except that sheets 30 and 54 do not overlap until they approach the a binding press 66 downstream of fuser 33 and the toner applied to the binding region is fused at fuser 33 and then refused at binding press 66.

Figure 6:
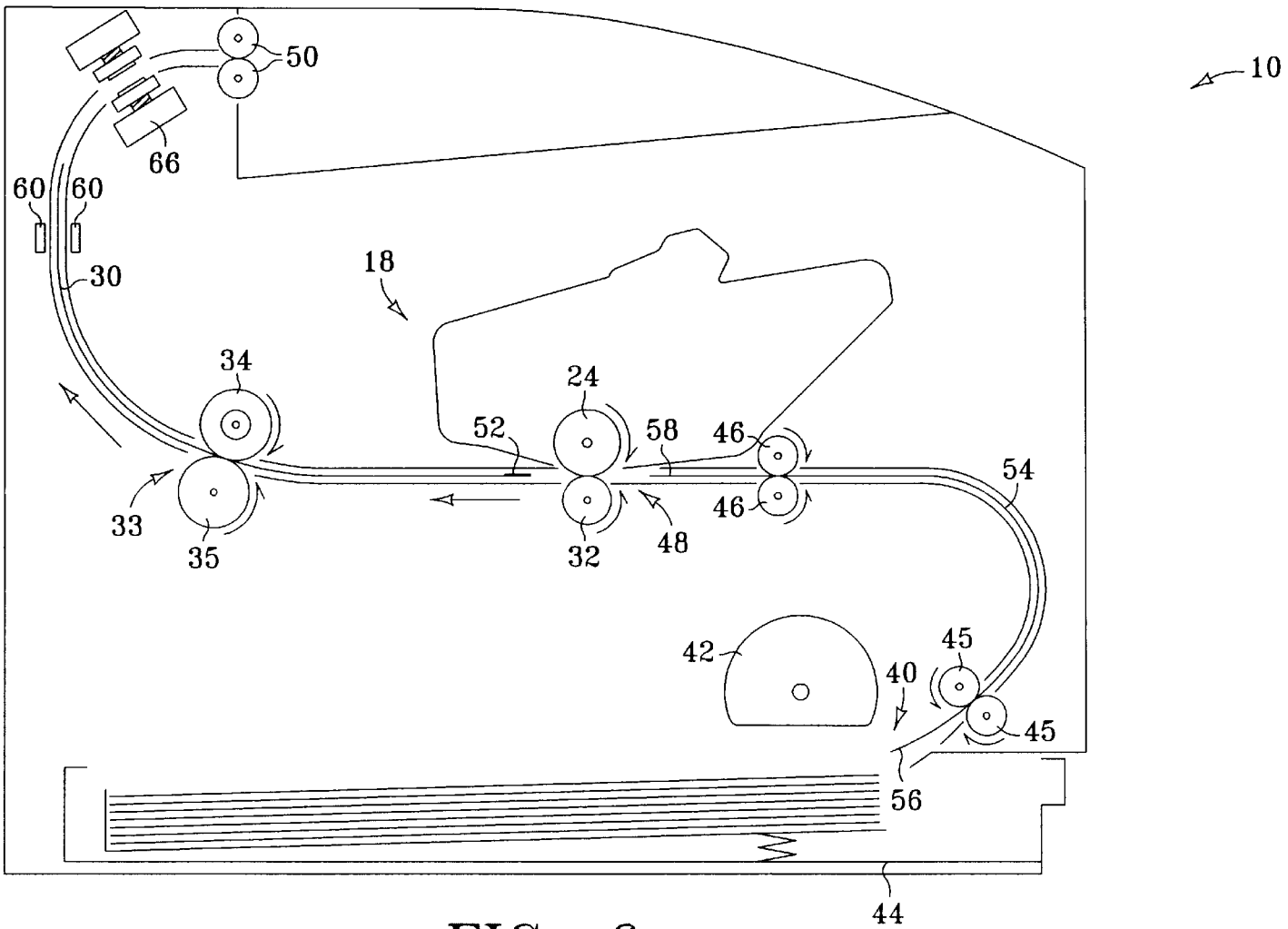
FIGS. 6–9 are side views of a laser printer such as the one illustrated in FIG. 1 showing the sequence of operation for another embodiment of the invention in which sheets are bound end to end with a binding press positioned downstream from the fuser.
Figure 7:
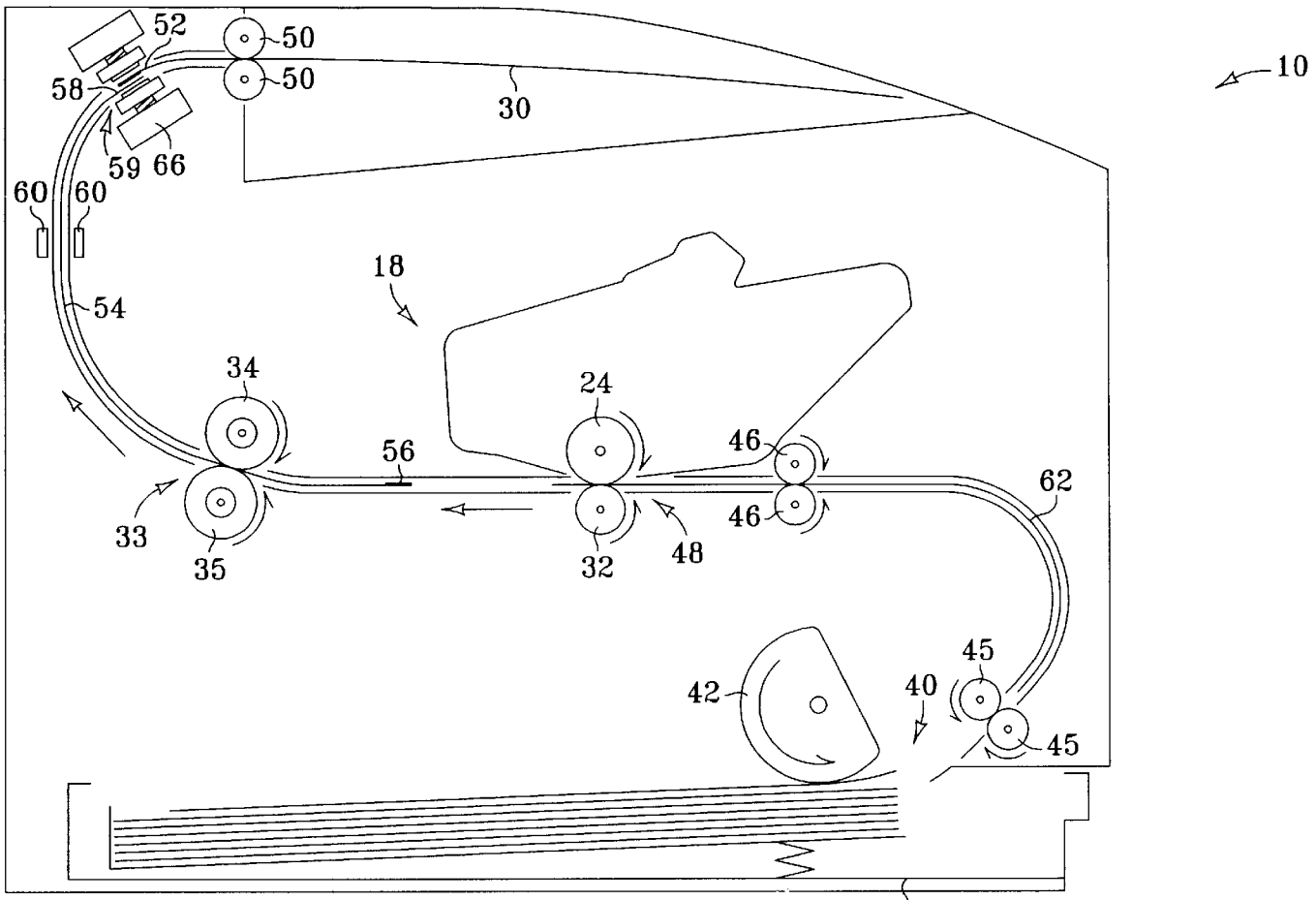

In FIG. 6, first media sheet 30 has cleared image area 48 and is passing through fuser 33. Toner has been applied to trailing edge 52 of first sheet 30 along with the desired print image, if any, as first sheet 30 passed through image area 48. A second sheet 54 is approaching image area 48. Toner will also be applied to trailing edge 56 of second sheet 54 along with the desired print image, if any, as second sheet 31 passes through image area 48. Again, toner need not be applied to the trailing edge of the final page since no binding will occur on that edge Referring to FIG. 7, first sheet 30 has cleared fuser 33 to fuse both the print image and the binder toner applied to trailing edge 52 and is moving through output rollers 50. As the leading edge 58 of second sheet 54 passes through fuser 33 and approaches output rollers 50, it overlaps trailing edge 52 of first sheet 30 at joint 59. In the preferred embodiment, this overlap is achieved by varying the speed of output rollers 50. For example, when leading edge 58 of second sheet 54 is detected by a sensor 60 positioned between fuser 33 and output rollers 50, the speed of output rollers 50 is slowed temporarily to allow leading edge 58 of second sheet 54 to overtake trailing edge 52 of first sheet 30. Once the desired overlap is achieved, the speed of output rollers 50 is resumed to again match the speed of the two sheets 30 and 54.

Figure 8:
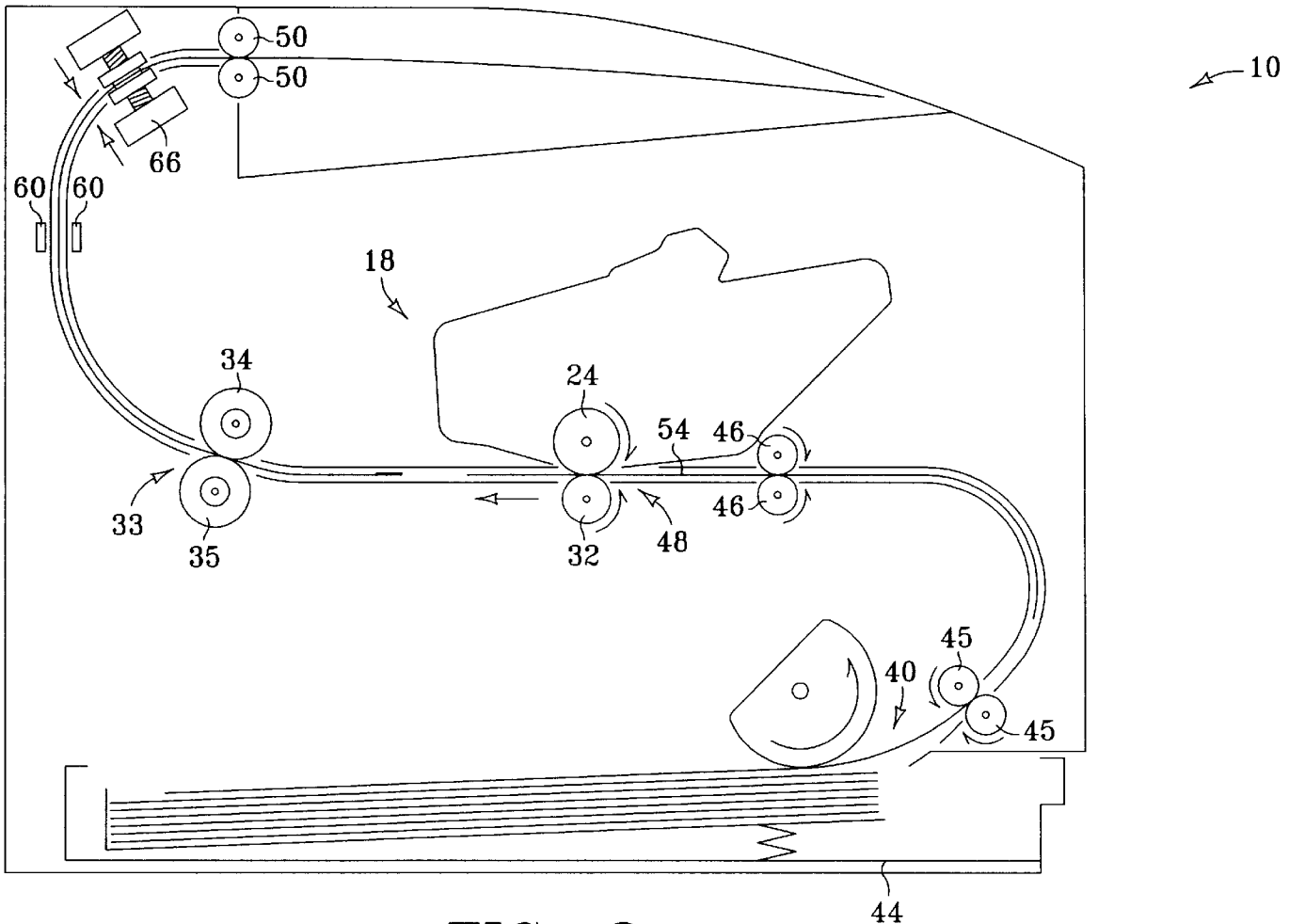
Figure 9:
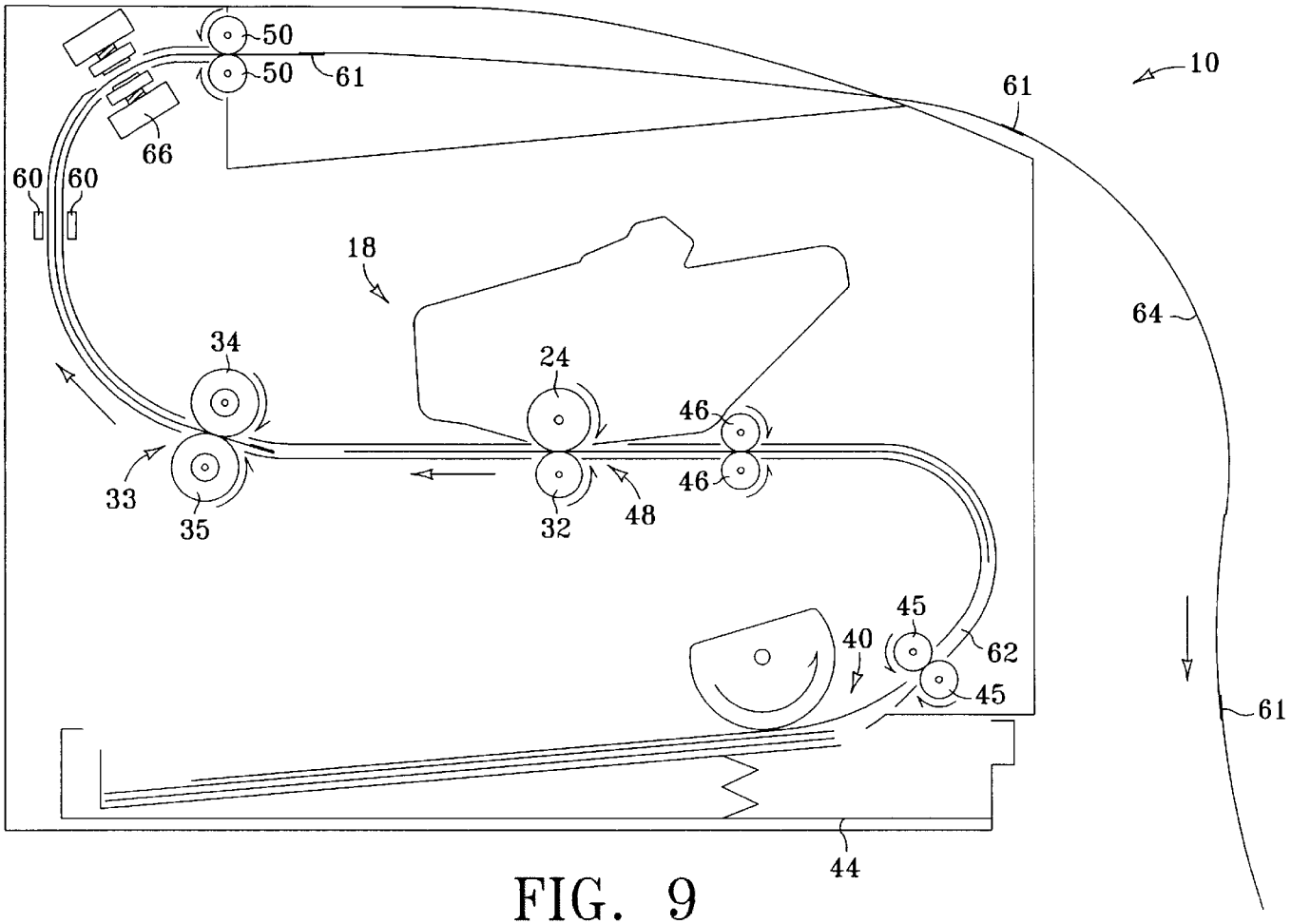

Referring to FIG. 8, press 66 closes on the overlapping edges of sheets 30 and 54 to reactivate the toner and fuse the edges together as they pass through press 60 to form a fused joint 61. This process is repeated for successive sheets 62 to form a continuous sheet 64 as shown in FIG. 9. A suitable press that utilizes a pair of heated platens is described in U.S. patent application Ser. No. 09/925,902 filed Aug. 9, 2001 and titled Post Print Finishing Device With Imaging Material Binder which is incorporated herein by reference in its entirety.

Figure 10:
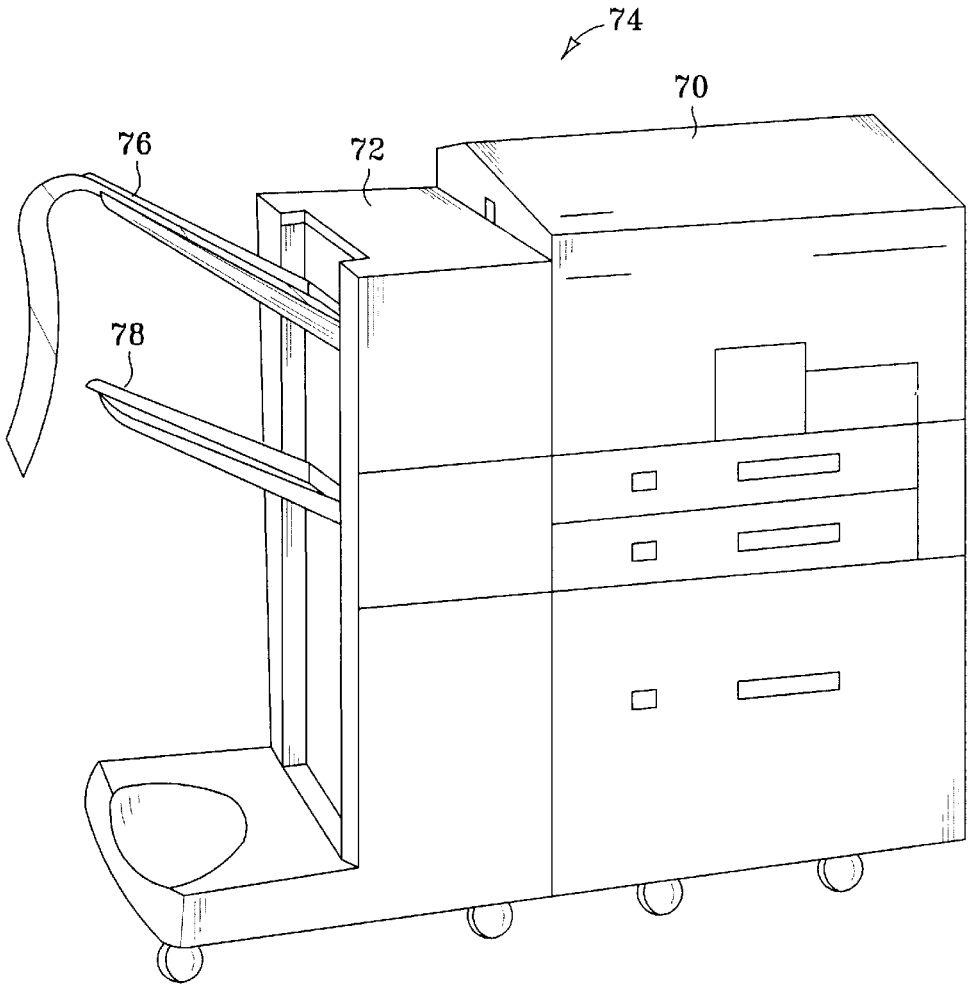
FIG. 10 is a perspective view of a printer and attached stacker illustrating one type of document printing and finishing system that may be used to implement the invention.

FIGS. 10–13 illustrate another embodiment in which the sheets are bound end to end in a stacker attached to the printer. FIG. 10 is a perspective view of a printer 70 and attached stacker 72 illustrating one type of document printing and finishing system that may be used to implement the invention. Referring to FIG. 10, printer 70 and stacker 72 together make up a document production system designated generally by reference number 74. Printed sheets are output by printer 70 to stacker 72 where they are routed to an upper output bin 76 or to a lower output bin 78. Unbound sheets and continuous bound sheets are routed face up to upper output bin 76. Bound documents are collected face down in lower output bin 78

Figure 12:
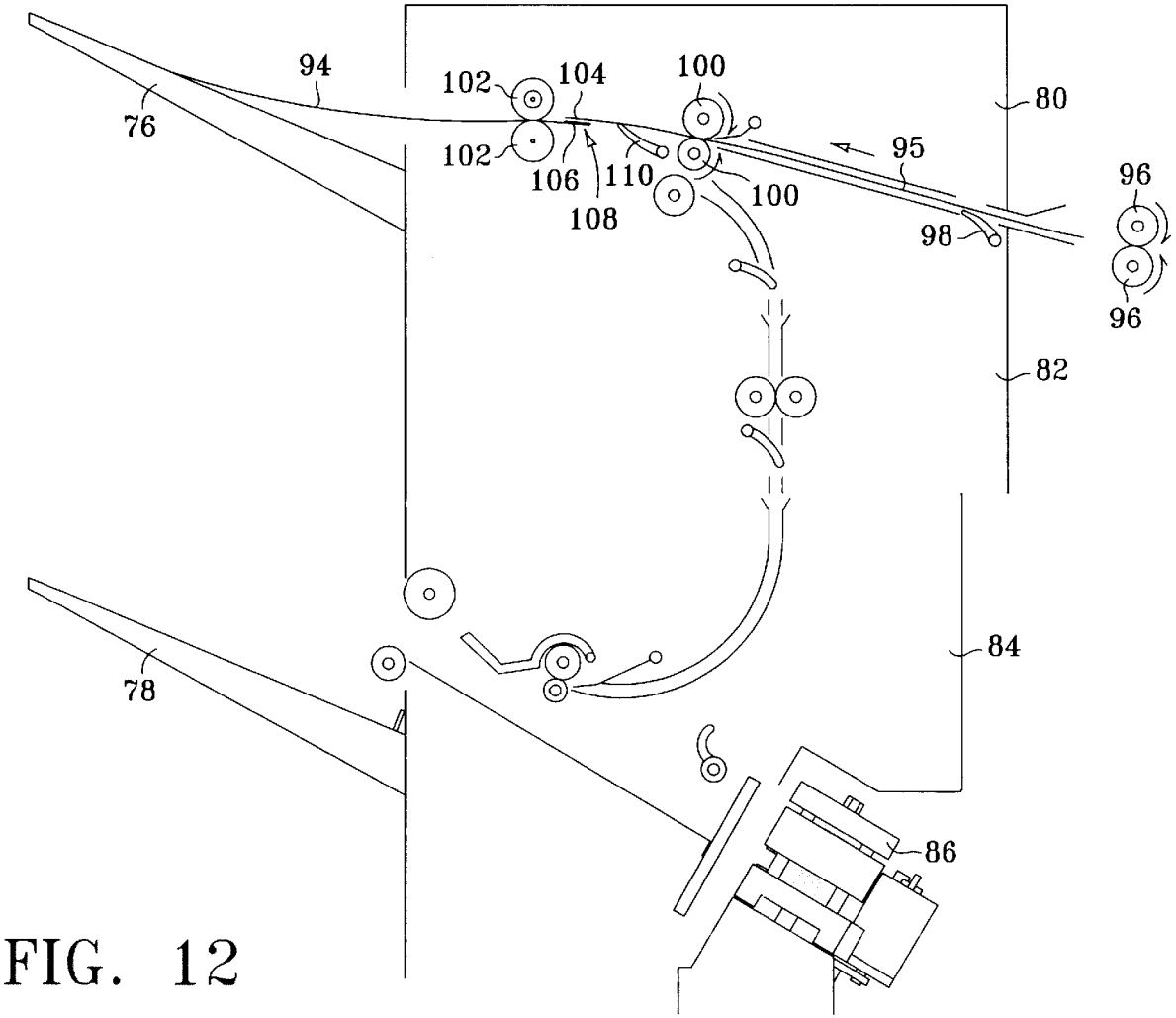
FIGS. 12–13 are more detailed side elevation views of the stacker of FIG. 11 showing the sequence of operation for one embodiment of the invention in which sheets are bound end to end with a fuser positioned in the flipper module.
Figure 13:
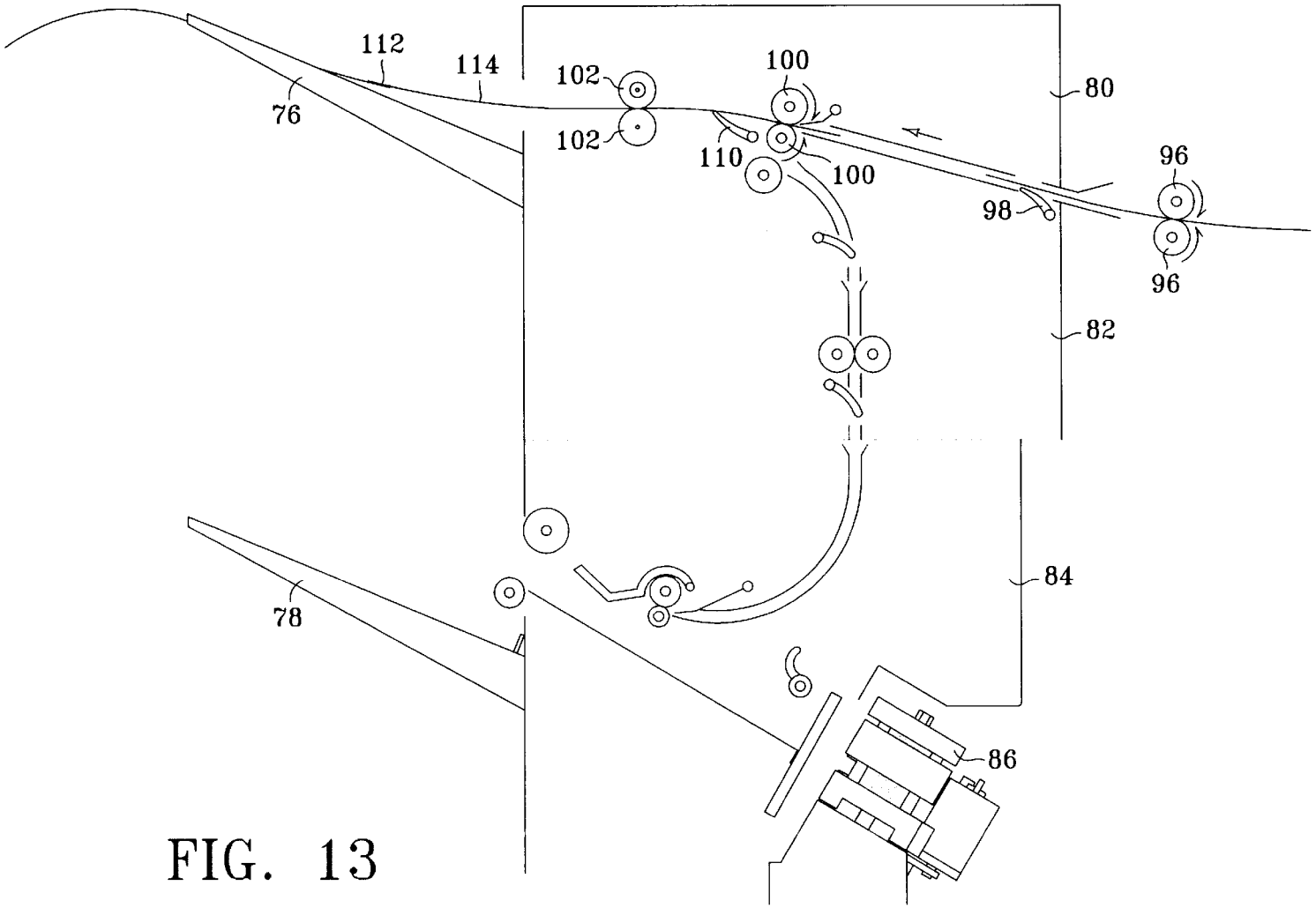

Stacker 72 will now be described with reference to FIGS. 11–13. FIG. 13 is a side elevation view looking into stacker 72 showing the modular design. Stacker 72 includes a continuous sheet binding and flipper module 80, a paper path module 82, an accumulator module 84 and a stacked sheet binder module 86. Each module is mounted to a frame 88. A power supply 90 and controller 92 are mounted to the lower portion of frame 88. Power supply 90 and controller 92 are electrically connected to the operative components of modules 80, 82, 84 and 86. Controller 92 contains the electronic circuitry and programming necessary to control and coordinate various functions of the components in stacker 72. The details of the circuitry and programming of controller 92 are not particularly important to the invention as long as the controller design is sufficient to direct the desired functions as described below.

Figure 11:
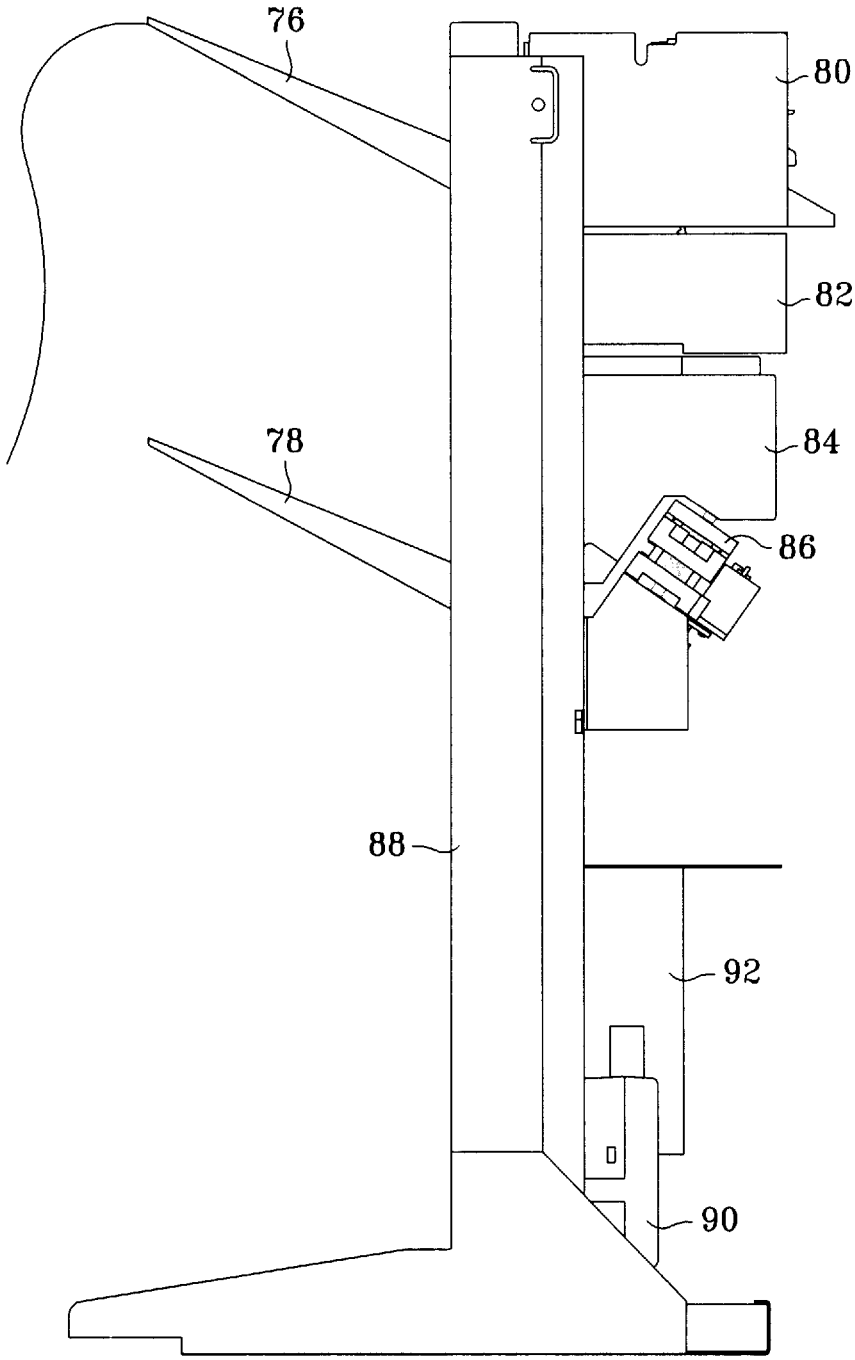
FIG. 11 is a side elevation view of a modular stacker that includes flipper, paper path, accumulator and binder modules.

The modular design of stacker 72 shown in FIG. 11 is adapted from the Hewlett-Packard Company model C8085A stapler/stacker. Each module 80, 82, 84 and 86 is operatively coupled to but otherwise independent of the adjacent module. In the stacker of the present invention, the flipper module used in the C8085A stapler/stacker is modified to include continuous sheet binding, the stapler module is replaced with stacked sheet binder module 86 and controller 92 is modified accordingly to control the operation of the binder rather than a stapler.

For sheets that will be stacked, bound and output to lower output bin 78, flipper module 80 makes the leading edge of each sheet output by printer 70 the trailing edge for routing to paper path module 82 and accumulator module 84. Flipping the sheets in this manner from face up to face down is necessary to properly stack the sheets in accumulator module 84 prior to stack binding. Paper path module 82 moves each sheet face down to accumulator module 84 where the sheets are collected, registered, moved to stacked sheet binder module 86 (when stack binding is desired) and then output to lower output bin 78 (bound or unbound). Stacked sheet binder module 86 reactivates the imaging material applied to select binding regions on sheets collected in accumulator module 84 to bind the sheets together. The stack binding aspect of the operation of stacker 72 is described in detail in the '902 application noted above.

The continuous sheet binding aspect of the operation of stacker 72 will now be described with reference to FIGS. 12 and 13. First and second media sheets 94 and 95 are output by printer 70 to stacker 72 through printer output rollers 96. As an entry sensor 98 detect a sheet entering continuous sheet binder and flipper module 80, entry rollers 100 and discharge/fuser rollers 102 are driven forward to move the sheets toward bin 76. As the leading edge 104 of second sheet 95 passes through entry rollers 100 and approaches fuser rollers 102, it overlaps trailing edge 106 of first sheet 94. This overlap is designated by reference number 108 in FIGS. 12 and 13. Preferably, this overlap is achieved by varying the speed of fuser rollers 102. For example, when leading edge 104 of second sheet 95 is detected by a sensor 110 positioned between entry rollers 100 and fuser rollers 102, the speed of fuser rollers 102 is slowed temporarily to allow leading edge 104 of second sheet 95 to overtake trailing edge 106 of first sheet 94. Once the desired overlap is achieved, the speed of fuser rollers 102 is resumed to again match the speed of the two sheets 94 and 95. The overlapping edges of sheets 94 and 95 are fused together at joint 112 as they pass through fuser rollers 102 and the imaging material applied to trailing edge 106 is reactivated. This process is repeated for successive sheets to form a continuous sheet 114 as shown in FIG. 13.

Figure 14:
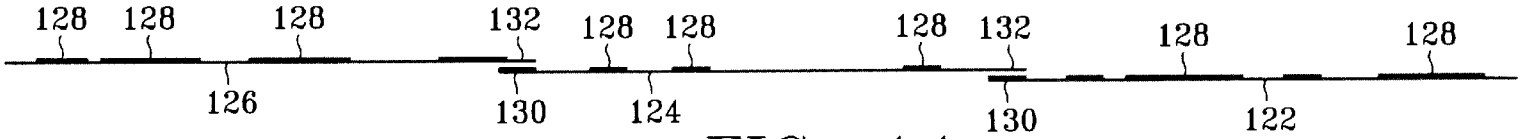
FIG. 14 is a side view of media sheets showing one configuration of end to end binding in which the following sheet is bound to the bottom side of the leading sheet such that the sheets stair step down as they are bound.
Figure 15:
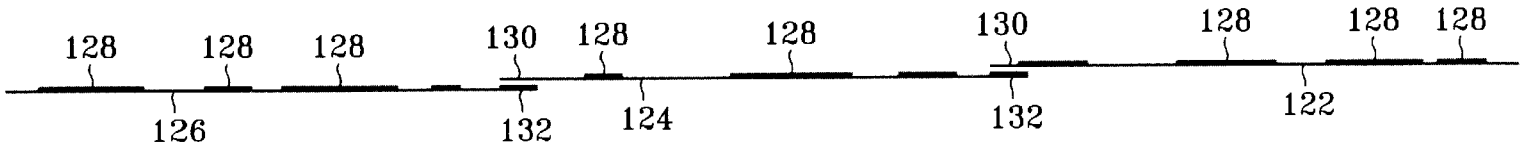
FIG. 15 is a side view of media sheets showing another configuration of end to end binding in which the following sheet is bound to the top side of the leading sheet such that the sheets stair step up as they are bound.
Figure 16:
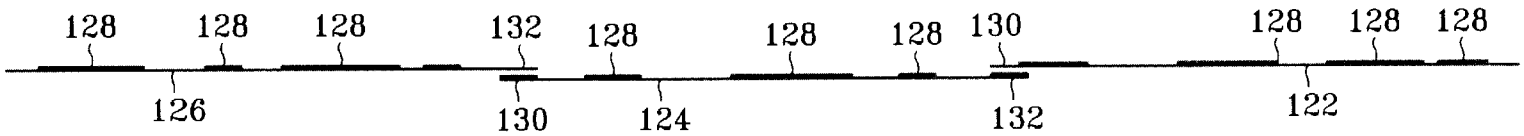
FIG. 16 is a side view of media sheets showing another configuration of end to end binding in which the following sheet is bound alternately to the top and bottom sides of the leading sheet.

FIGS. 14–16 show three different configurations for overlapping the first and second sheets. Imaging material is applied to each sheet 122, 124 and 126 in the desired print image 128, if any. In the configuration of FIG. 14, imaging material is also applied for binding to the leading edge 130 of each following sheet 124, 122 which is lapped under the trailing edge 132 of each leading sheet 126, 124. In the configuration of FIG. 15, imaging material is applied for binding to the trailing edge 132 of each leading sheet 126, 124 which is lapped under the leading edge 130 of each following sheet 124, 122. In the configuration of FIG. 16, imaging material is applied for binding to the leading and trailing edges 130 and 132 of the middle sheet 124 which is lapped under the trailing edge of the leading sheet 126 and the leading edge of the following sheet 122.

The binding methods of the present invention can be implemented through computer readable media that contain instructions for performing the desired acts, the memory in controllers 16 and 92 or a printer driver on a remote/host computer for example, for use by or in connection with an instruction execution system, such as the processors in controllers 16 and 92 or the host computer. A "computer-readable medium" includes any of the many physical media such as electronic, magnetic, optical, electromagnetic, infrared, or semiconductor media. More specific examples of a suitable computer-readable medium would include, but are not limited to, a magnetic computer diskette such as floppy diskettes or hard drives, a random access memory (RAM), a read-only memory (ROM), an erasable programmable read-only memory, or a compact disc.

The present invention has been shown and described with reference to the foregoing embodiments by way of example only. Other embodiments are possible. For example, implementing the invention in an attached stacker or a stand alone appliance is not limited to a multi-function modular stacker like the stacker 72 described above. A more simple unit that provides only continuous sheet binding may be used. It is to be understood, therefore, that various embodiments, forms and details may be made without departing from the spirit and scope of the invention which is defined in the following claims.

What is claimed is:

1. A method of binding sheet media, comprising:

applying imaging material to a binding region along a trailing edge of a first sheet;

overlapping the trailing edge of the first sheet with a second sheet; and activating the imaging material applied to the binding region of the first sheet.

2. The method of claim 1, wherein the act of overlapping comprises overlapping the trailing edge of the first sheet with a leading edge of the a second sheet.

3. A method of binding sheet media, comprising:

providing a first sheet followed by a second sheet;

applying imaging material to a binding region along a leading edge of the second sheet;

overlapping the leading edge of the second sheet with the first sheet; and activating the imaging material applied to the binding region of the second sheet.

4. The method of claim 3, wherein the act of overlapping comprises overlapping the leading edge of the second sheet with a the trailing edge of the first sheet.

5. A method of continuous sheet printing, comprising:

applying imaging material in a pattern of a desired print image on a plurality of sheets;

applying imaging material to a binding region along a leading edge or trailing edge of each sheet;

overlapping the leading edge of each sheet with the trailing edge of an adjacent sheet; and activating the imaging material in the pattern and in the binding region.

6. A method of continuous sheet printing, comprising:

applying imaging material in a pattern of a desired print image on a plurality of sheets;

applying imaging material to a binding region along a leading edge or trailing edge of each sheet;

activating the imaging material in the print pattern and in the binding region;

overlapping the leading edge of each sheet with the trailing edge of an adjacent sheet; and re-activating the imaging material in the binding region of each sheet.

7. A computer readable medium having instructions for:

applying imaging material to a binding region along a trailing edge of a first sheet;

overlapping the trailing edge of the first sheet with a second sheet; and activating the imaging material applied to the binding region of the first sheet.

8. The medium of claim 7, wherein the instructions for overlapping comprise instructions for overlapping the trailing edge of the first sheet with a leading edge of a second sheet.

9. A computer readable medium having instructions for:

providing a first sheet followed by a second sheet;

applying imaging material to a binding region along a leading edge of the second sheet;

overlapping the leading edge of the second sheet with the first sheet; and activating the imaging material applied to the binding region of the second sheet.

10. The medium of claim 9, wherein the instructions for overlapping comprise instruction for overlapping the leading edge of the second sheet with a trailing edge of the first sheet.

11. A computer readable medium having instructions for:

applying imaging material in a pattern of a desired print image on one or more of a plurality of sheets;

applying imaging material to a binding region along a leading edge or trailing edge of each sheet;

overlapping the leading edge of each sheet with the trailing edge of an adjacent sheet; and activating the imaging material in the pattern and in the binding region.

12. A computer readable medium having instructions for:

applying imaging material in a pattern of a desired print image on one or more of a plurality of sheets;

applying imaging material to a binding region along a leading edge or trailing edge of each sheet;

activating the imaging material in the pattern and in the binding region;

overlapping the leading edge of each sheet with the trailing edge of an adjacent sheet; and re-activating the imaging material in the binding region of each sheet.

13. A printing device, comprising:

a print engine including a photoconductor and a fuser;

a controller operatively coupled to the print engine; and the controller having a processor and programmable memory configured to transmit electronic signals to the print engine to apply toner in a pattern of a desired print image on one or more of a plurality of sheets, apply toner to a binding region along a leading edge or trailing edge of each sheet, overlap the leading edge of each sheet with the trailing edge of an adjacent sheet and fuse the toner in the pattern and in the binding region.

14. The printing device of claim 13, further comprising a formatter, the controller operatively coupled between the formatter and the print engine, the formatter having a processor and programmable memory configured to generate and transmit to the controller electronic data representing the desired print image and binding region of each sheet.

15. The printing device of claim 14, wherein the formatter and the controller form one integral component of the printing device.

16. A computer readable medium having instructions for:

defining a binding region along a trailing edge of a first sheet; and generating instructions for a printing device to apply imaging material to the binding region of the first sheet, overlap the trailing edge of the first sheet with a second sheet, and activate the imaging material applied to the binding region of the first sheet.

17. The medium of claim 16, further comprising instructions for transmitting the generated instructions to the printing device.

18. A computer readable medium having instructions for:

defining a first sheet and a second sheet;

defining a binding region along a leading edge of the second sheet; and generating instructions for a printing device to apply imaging material to the binding region of the second sheet, overlap the leading edge of the second sheet with the first sheet, and activate the imaging material applied to the binding region of the second sheet.

19. A computer readable medium having instructions for:

defining a pattern of a desired print image on one or more of a plurality of sheets;

defining a binding region along a leading edge or trailing edge of each sheet; and generating instructions for a printing device to apply imaging material to the sheets in the pattern of the desired print image, apply imaging material to the binding region of each sheet, overlap the leading edge of each sheet with the trailing edge of an adjacent sheet, and activate the imaging material in the pattern and in the binding region.

* * * * *

UNITED STATES PATENT AND TRADEMARK OFFICE

CERTIFICATE OF CORRECTION

PATENT NO. : 6,577,845 B2
DATED : June 10, 2003
INVENTOR(S) : Chad A. Stevens

It is certified that error appears in the above-identified patent and that said Letters Patent is hereby corrected as shown below:

Column 2,
Line 58, delete “iQ” and insert therefor -- 10 --

Column 3,
Line 47, after “according” delete “a”

Column 6,
Line 67, after “a” delete “the”

Column 7,
Line 16, after “the” delete “print”

Signed and Sealed this

Eighteenth Day of January, 2005

JON W. DUDAS
*Director of the United States Patent and Trademark Office*